US006212773B1

(12) United States Patent
Colombo

(10) Patent No.: US 6,212,773 B1
(45) Date of Patent: Apr. 10, 2001

(54) METHOD OF SHAPING PROFILED FRAME MEMBERS, AND METHOD OF MANUFACTURING FRAMES

(76) Inventor: Daniel Colombo, La Daleure - F-38590, Saint-Etienne-de-Saint Geoirs (FR)

( * ) Notice: Subject to any disclaimer, the term of this patent is extended or adjusted under 35 U.S.C. 154(b) by 0 days.

(21) Appl. No.: 08/586,872

(22) PCT Filed: Aug. 4, 1994

(86) PCT No.: PCT/FR94/00978

§ 371 Date: Jul. 22, 1996

§ 102(e) Date: Jul. 22, 1996

(87) PCT Pub. No.: WO95/04617

PCT Pub. Date: Feb. 16, 1995

(30) Foreign Application Priority Data

Aug. 4, 1993 (FR) ..... 93 09622

(51) Int. Cl.[7] ..... B21D 47/00

(52) U.S. Cl. ..... 29/897.312; 29/464; 29/515; 409/192; 409/203

(58) Field of Search ..... 29/897.312, 464, 29/505, 515, 897.31; 409/192, 203, 217; 140/108, 109; 72/306

(56) References Cited

U.S. PATENT DOCUMENTS 3,442,175 * 5/1969 Heap et al. ..... 409/203
4,423,990 * 1/1984 Kodama et al. ..... 409/203

FOREIGN PATENT DOCUMENTS

| | | |
|---|---|---|
| 2 623 750 | 12/1977 | (DE) . |
| 3 042 284 | 6/1982 | (DE) . |
| 90 13 247 | 3/1991 | (DE) . |
| 92 07 578 | 10/1992 | (DE) . |
| 92 14 208 | 1/1993 | (DE) . |
| 7323801 | 1/1975 | (FR) . |
| 2 259 222 | 8/1975 | (FR) . |
| 2 644 202 | 9/1990 | (FR) . |
| 1 484 127 | 8/1977 | (GB) . |

* cited by examiner

*Primary Examiner*—P. W. Echols
(74) *Attorney, Agent, or Firm*—Smith, Gambrell & Russell, LLP

(57) ABSTRACT

A method for forming shaped members by drilling, milling or pushing. The positions of tools are preset with respect to at least one reference surface of the machine. A reference surface of each of the members to be machined is placed on the machine reference surface. The tools are moved in union relative to the member on the machine so that at least one tool in the set can carry out a machining step on at least one side wall of the member. The tools are preset and the member is shaped in such a way that members of various cross sections may be suitably machined from the same set of tools.

9 Claims, 9 Drawing Sheets

METHOD OF SHAPING PROFILED FRAME MEMBERS, AND METHOD OF MANUFACTURING FRAMES

The present invention relates in particular to a method of shaping profiled frame members, to a method of manufacturing frames, to frames made from profiled members and to profiled members of specific structure.

The techniques currently employed for manufacturing frames which are to form casings, opening leaves or fixed frames for producing closures or walls are very cumbersome owing to the fact that the profiled members exhibit sections which are completely different from one frame to the next so that the positions of the tools of the machines which are used to manufacture the frames have to be set each time.

This is why all that can be done is to prefabricate all the pieces of profiled members which are to form the opening leaves and store them, to manufacture the frames forming these opening leaves and to store them, then to prefabricate all the pieces of profiled members which are to form the casings and store them, to manufacture the frames constituting these casings and to store them. It is then necessary to take them back up one after another, fitting them out or sorting them in terms of size in order actually to make closures.

The object of the present invention is to overcome these drawbacks in particular, at least in part.

The foremost subject of the present invention is a method of shaping profiled members in which method the profiled members undergo shaping operations, particularly drilling, milling or punching, on a machine using at least one tool.

According to the invention, this method consists in presetting the position of the tools of a set of interconnected tools with respect to at least one reference surface of the machine. Furthermore, it consists, in succession for each of the profiled members to be shaped, in placing a predetermined reference face of the profiled member to be shaped on the reference surface of the machine, in moving the tools in unison with respect to said profiled member to be shaped mounted on the machine so as to carry out the shaping operation executed by at least one tool of said set of tools in at least one lateral wall of this profiled member, and in removing said profiled member from the machine after shaping; the presetting of the tools and the shape of the profiled members being such that profiled members of different sections may undergo the desired operations with the use respectively of the tools corresponding to these operations selected from said set of tools.

According to the invention, the aforementioned tools may in particular be rotary machining tools, punching tools, clamping tools, tools for welding, for example spot welding, pinning or other operations.

In an alternative, the method according to the invention, in which the operation to be carried out is a punching operation, consists, after having placed in the profiled member to be shaped an inner piece engaged longitudinally inside this profiled member, in placing this profiled member to be shaped on the reference surface of the machine, and in carrying out the punching operation using at least one of the punching tools of said set of tools so as to deform the profiled member inward, into a hollow part of said piece.

Another subject of the present invention is a method of manufacturing frames each comprising profiled members connected by joining pieces respectively engaged longitudinally in the adjacent profiled members of the frame, on a punching machine using punching tools.

According to the invention, this method consists in presetting the position of the tools of a set of interconnected punching tools with respect to at least one reference surface of the machine. Furthermore, it consists, in succession for each of the frames to be manufactured, and after they have been preassembled using said joining pieces, in placing a predetermined reference face of the frame to be manufactured, of one side of the frame, on the reference surface of the machine, in moving the punching tools in unison with respect to said profiled member to be shaped mounted on the machine so as to carry out the punching operation using at least one of the punching tools of said set of punching tools in order to deform the profiled members inward, into hollow parts of said joining pieces, and in removing said frame from the machine after punching; the presetting of the punching tools and the shape of the profiled members being such that frames respectively exhibiting profiled members of different sections can undergo the desired punching operations with the use respectively of the punching tools corresponding to these operations selected from said set of punching tools.

The method of manufacturing frames according to the invention may advantageously consist in preassembling the frame in such a way that its opposed parts are separated, in placing the predetermined reference face of this frame on the reference surface of the machine, in placing a panel in the space of the frame, in bringing the opposed parts of the frame closer together so as to engage the edges of the panel in slots of the frame and in carrying out the punching operation.

The method of manufacturing frames according to the invention may advantageously consist in placing said frame sideways on to said sets of punching tools.

According to the method of manufacturing frames of the invention, each frame may advantageously be formed by profiled members of identical section.

The method of manufacturing frames according to the invention may advantageously consist, in succession for each of the frames to be manufactured, in preparing four pieces of a profiled member and in executing the aforementioned preassembly operation.

Another subject of the present invention is frames formed respectively by profiled members of different sections.

According to the invention, these frames preferably exhibit a reference face on one side, and they exhibit shaped regions executed laterally and of which at least some of the regions of each of the frames are situated equal distances away from their reference face and of which the other regions of each of the frames do not correspond to one another, these other regions of one of the frames corresponding to hollow or lateral parts of the other frame.

According to the invention, each frame is preferably formed by profiled members of identical section.

According to the invention, the shaped regions may be punched regions.

Another subject of the present invention is profiled members of specific structure.

Another subject of the present invention is a profiled member of L-shaped section, which preferably comprises, in its first flange, two superposed longitudinal channels, and in its second flange, one longitudinal channel offset toward the outside, in the direction of its first flange with respect to the channel in the latter which is adjacent to it.

According to the invention, its first flange may advantageously exhibit, between its channels, longitudinal joining strips, preferably made of a thermally insulating material.

According to the invention, the edge of its second flange exhibits a free-standing wall turned back toward its first flange.

According to the invention, it exhibits a longitudinal rib in the inner region where its aforementioned flanges meet.

Another subject of the present invention is a profiled member which comprises at least one first longitudinal channel adjacent to a second longitudinal channel and to a longitudinal slot extending opposite this second channel.

According to the invention, it comprises, opposite its aforementioned slot, a free-standing wall which extends its wall opposite its second channel and this slot.

The present invention will be better understood upon a study of profiled members and of frames manufactured from these profiled members and of a machine for this manufacture, which are described by way of non-limiting examples and are illustrated by the drawing in which.

Figure 1:
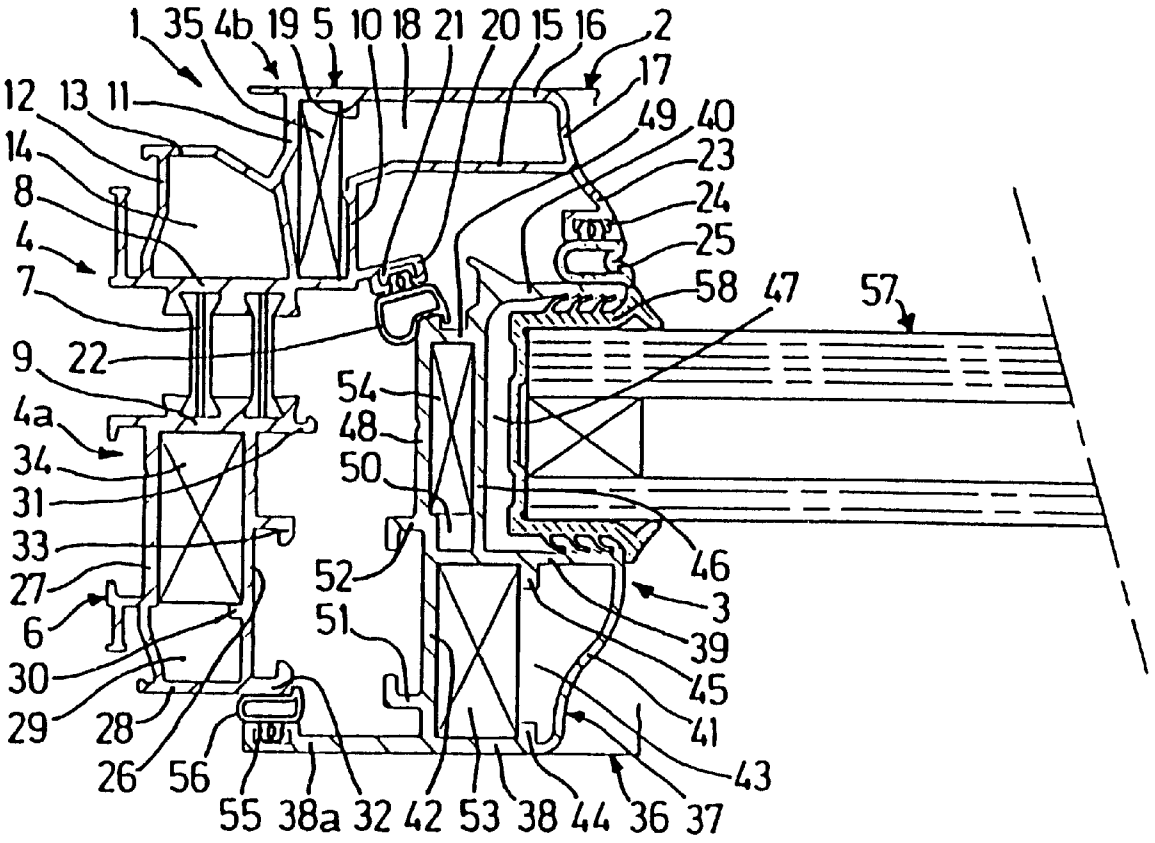
FIG. 1 represents a transverse section through an upright or crosspiece of a closure with an opening leaf.

Referring now to FIG. 1, closure 1 includes a frame forming a casing 2 and an opening leaf 3. This opening leaf may be a window or a door.

The uprights and cross pieces of the casing frame 2, which have identical sections, are manufactured from a profiled member 4.

The profiled member 4 comprises an outer profiled member 5 and an inner profiled member 6. These profiled members 5 and 6 exhibit opposed walls 8 and 9 which are parallel to the plane of the frame, and which exhibit opposed ribs between which are engaged the longitudinal joining strips 7 made of an insulating material which avoids thermal bridging between the outer profiled member 5 and the inner profiled member 6.

The profiled member 5 comprises, starting from its wall 8, walls 10, 11 and 12 which extend outward, the wall 11 being placed between and some distance from the walls 10 and 12 and being wider than them.

The outer edge of the wall 12 is connected to the wall 11, substantially at its middle, by a wall 13 substantially parallel to the wall 8, so that a longitudinal channel 14 is delimited between the opposed walls 8 and 13 and the opposed walls 11 and 12.

Starting from the outer edges of the walls 10 and 11, the profiled member 5 comprises longitudinal walls 15 and 16 which extend, opposite the longitudinal channel 14, parallel to the plane of the frame 2, their edges being connected by a longitudinal wall 17 perpendicular to this plane so that the profiled member 5 exhibits a longitudinal channel 18 of L-shaped section and bounded by the walls 10, 11, 15, 16 and 17. The wall 16 constitutes the outer face of the frame 2.

In the longitudinal channel 18, the wall 16 exhibits a projecting longitudinal rib 19 situated facing the wall 10.

In the corner between the walls 8 and 10, the profiled member 5 exhibits a longitudinal wall 20, which extends the wall 8 and is inclined slightly toward the wall 15. This wall 20 exhibits a longitudinal slot 21 in which there is engaged a longitudinal rib for fastening a longitudinal gasket 22.

In the corner between the walls 15 and 17, the profiled member 5 exhibits a longitudinal wall 23 which extends the wall 17 inward. At the end of this wall 23 there is provided a longitudinal slot 24 in which there is engaged a longitudinal part for fastening a longitudinal gasket 25.

The inner profiled member 6 exhibits two longitudinal walls 26 and 27 which extend inward from its wall 9. The edges of these walls 26 and 27 are connected by a longitudinal wall 28 parallel to the plane of the frame 2, so that the walls 9, 26, 27 and 28 bound a longitudinal channel 29. The wall 28 constitutes the inner wall of the frame 2.

The wall 26 of the profiled member 6 exhibits, some distance from the wall 28, a projecting longitudinal rib 30.

In the corner between its walls 9 and 26, and in the corner between its walls 26 and 28, the profiled member 6 exhibits longitudinal catching ribs 31 and 32 and the wall 26 exhibits, substantially at its middle, a longitudinal catching rib 33.

At each of the corners of the frame 2 there are provided two joining brackets 34 and 35, the longitudinal branches of which are engaged in the channel 29 and the channel 18 respectively of the profiled member 37. The branches of the joining bracket 34 are placed between the rib 30 and the wall 9 and between the walls 26 and 27. The branches of the joining bracket 35 are placed between the opposed walls 8 and 16 and between the opposed walls 10 and 11. These joining brackets 34 and 35 are crimped as will be described later.

In this way, the profiled member 4 is of L-shaped section and comprises, in its first flange 4*a*, two superposed longitudinal channels 14 and 29 and, in its second flange 4*b*, one longitudinal channel 18 offset outward in the direction of its first flange 4*a* with respect to the channel 14 of the latter which is adjacent to it. Its first flange 4*a* exhibits, between its channels 14 and 29, longitudinal joining strips 7 made of a thermally insulating material. The edge of its second flange 4*b* exhibits a free-standing wall 23 turned back toward its first flange 4*a*. The profiled member 4 exhibits a longitudinal rib 20 in the inner region where its aforementioned flanges 4*a* and 4*b* meet, and its first flange 4*a* exhibits, on the same side as its second flange 4*b*, catching ribs 31, 32 and 33.

As FIG. 1 shows, the opening leaf 3 comprises a peripheral frame 36 made from a profiled member 37 which has an identical section for its uprights and for its crosspieces, this profiled member 37 exhibiting the following structure.

The profiled member 37 exhibits a wall 38 which constitutes the inner face of the frame 36, a middle wall 39 and a wall 40 which constitutes the outer face of the frame 36, these walls 38, 39 and 40 extending parallel to the plane of the frame 36.

The edges which are inside the frame 36 of the walls 38 and 39 are connected by a longitudinal wall 41 of S-shaped section, and the edge outside the frame 36 of the wall 39 is connected to the wall 38 by a longitudinal wall 42 which extends perpendicularly to the plane of the frame 36 and which meets the wall 38 substantially at its middle, so that the profiled member 37 exhibits a longitudinal channel 43 bounded by the walls 38, 39, 41 and 42. In this channel 43, the walls 38 and 39 exhibit opposed longitudinal ribs 44 and 45.

The edge outside the frame 36 of the wall 40 is connected to the wall 39 by a longitudinal wall 46 which extends perpendicularly to the plane of the frame 36, thus bounding, on the side inside the frame 36, a longitudinal slot 47 between the walls 39 and 40.

The wall 42 is extended by a longitudinal wall 48 which extends perpendicularly to the plane of the frame 36 and facing the wall 46. The outer edge of this wall 48 is connected to the wall 46, close to the wall 40, by a wall 49 which extends parallel to the plane of the frame 36 so that the profiled member 37 exhibits a longitudinal channel 50 bounded by the walls 39, 46, 48 and 49.

On the side outside the frame 36, the walls 42 and 48 bear longitudinal catching ribs 51 and 52.

At each of the corners of the frame 36 there are provided two joining brackets 53 and 54, the longitudinal branches of which are engaged in the channel 43 and the channel 50 respectively of the profiled member 37. The branches of the bracket 53 being placed between the longitudinal ribs 44 and 45 and the wall 42 and between the walls 38 and 39. The branches of the bracket 54 being placed between the walls 46 and 48 and between the walls 39 and 49. These joining brackets 53 and 54 are crimped as will be described later.

The edge of the wall 38, situated some distance from the wall 42, on the side outside the frame 36, is provided with a longitudinal slot 55 in which the longitudinal fastening part of a longitudinal gasket 56 is engaged.

The opening leaf 3 furthermore comprises a panel 57 which, in the example, is a double glazing unit. The peripheral edge of this panel 57 is enveloped by a mounting and sealing gasket 58. The peripheral edge of the panel 57 is engaged in the slot 47 of the profiled member 37 of the frame 36, the mounting and sealing gasket 58 being compressed and coming to bear against the edges inside the frame 36 of the walls 39 and 40.

In this way, the profiled member 37 comprises a first longitudinal channel 43 adjacent to a second longitudinal channel 50 and to a longitudinal slot 47, the latter extending opposite this second channel 54. It comprises, opposite this slot 47, a free-standing wall 38*a* which extends its wall opposite its second channel 50 and this slot 47.

As FIG. 1 shows, when the opening leaf 3 is in the closed position, the sealing gasket 56 bears against the wall 28 of the profiled member 4 and/or its rib 32, the sealing gasket 22 of the profiled member 4 bears against the angle between the walls 48 and 49 of the profiled member 37 and the sealing gasket 25 of the profiled member 4 bears against the wall 40 of the profiled member 37, the gasket 25 and the gasket 58 also bearing against one another, passing in front of the edge of the wall 40.

The ribs 32 and 51 and the ribs 33 and 52 are respectively situated facing one another, with respect to the mid-plane of the closure 1. The walls 17 and 23 of the profiled member 4 and the wall 41 of the profiled member 37 exhibit shapes which are symmetric with respect to the mid-plane of the closure 1 and the outer and inner faces of the panel 57 are equidistant from the faces of the walls 16 and 38 so that the shapes of the outer wall and of the inner wall of this closure 1 are substantially identical.

Furthermore, the catching ribs 32, 33 and 51, 52 are advantageously used to mount hinges and locking members.

Figure 2:
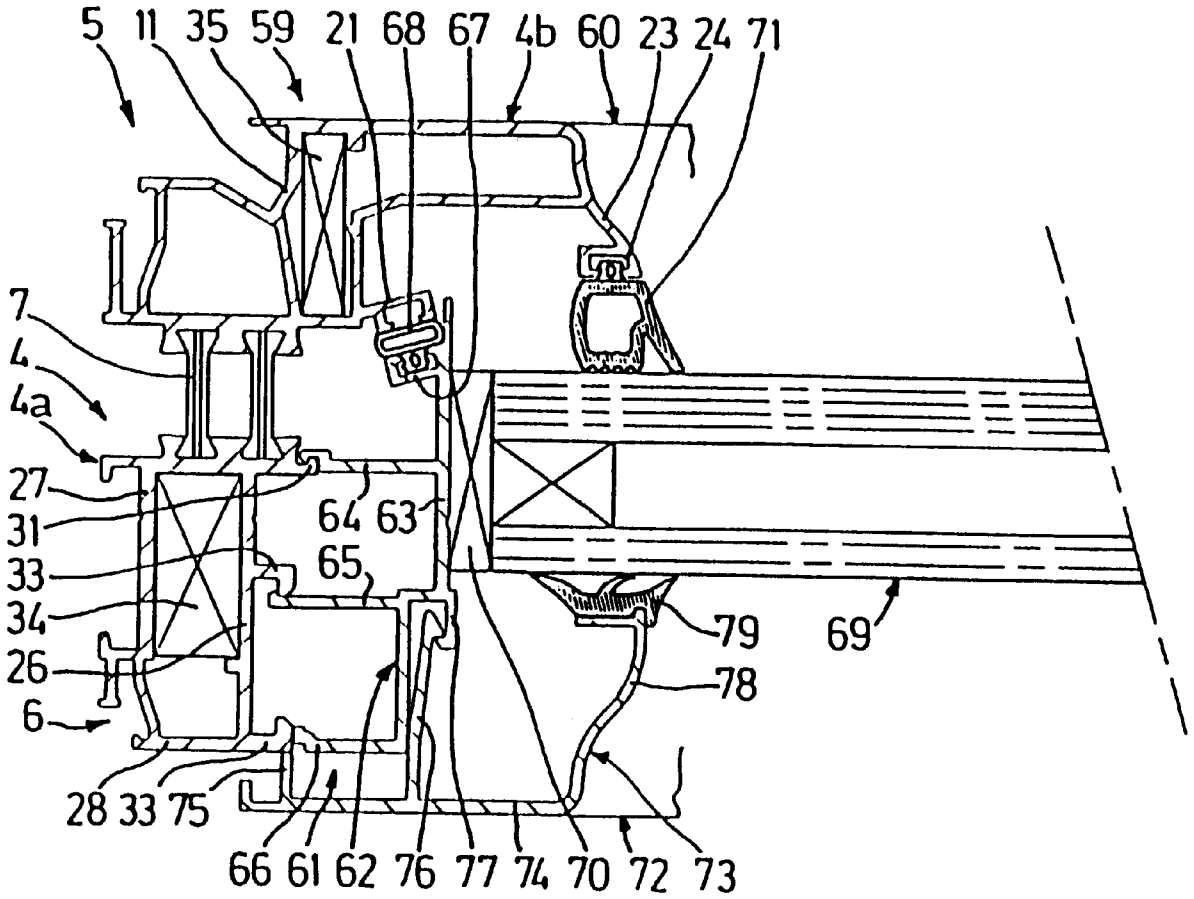
FIG. 2 represents a transverse section through an upright or crosspiece of a fixed closure.
Figure 3:
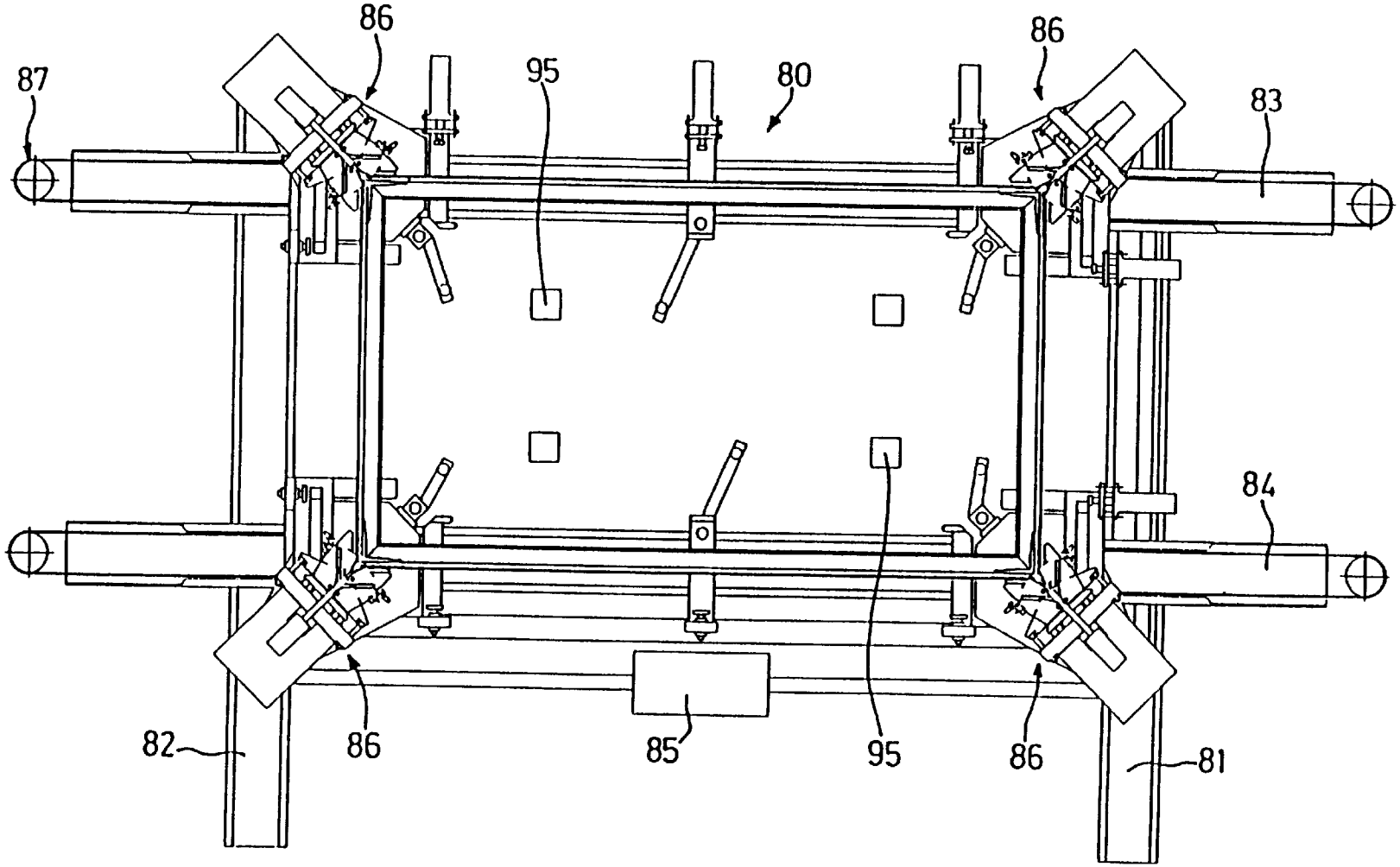
FIG. 3 represents a plan view of a frame punching machine.
Figure 4:
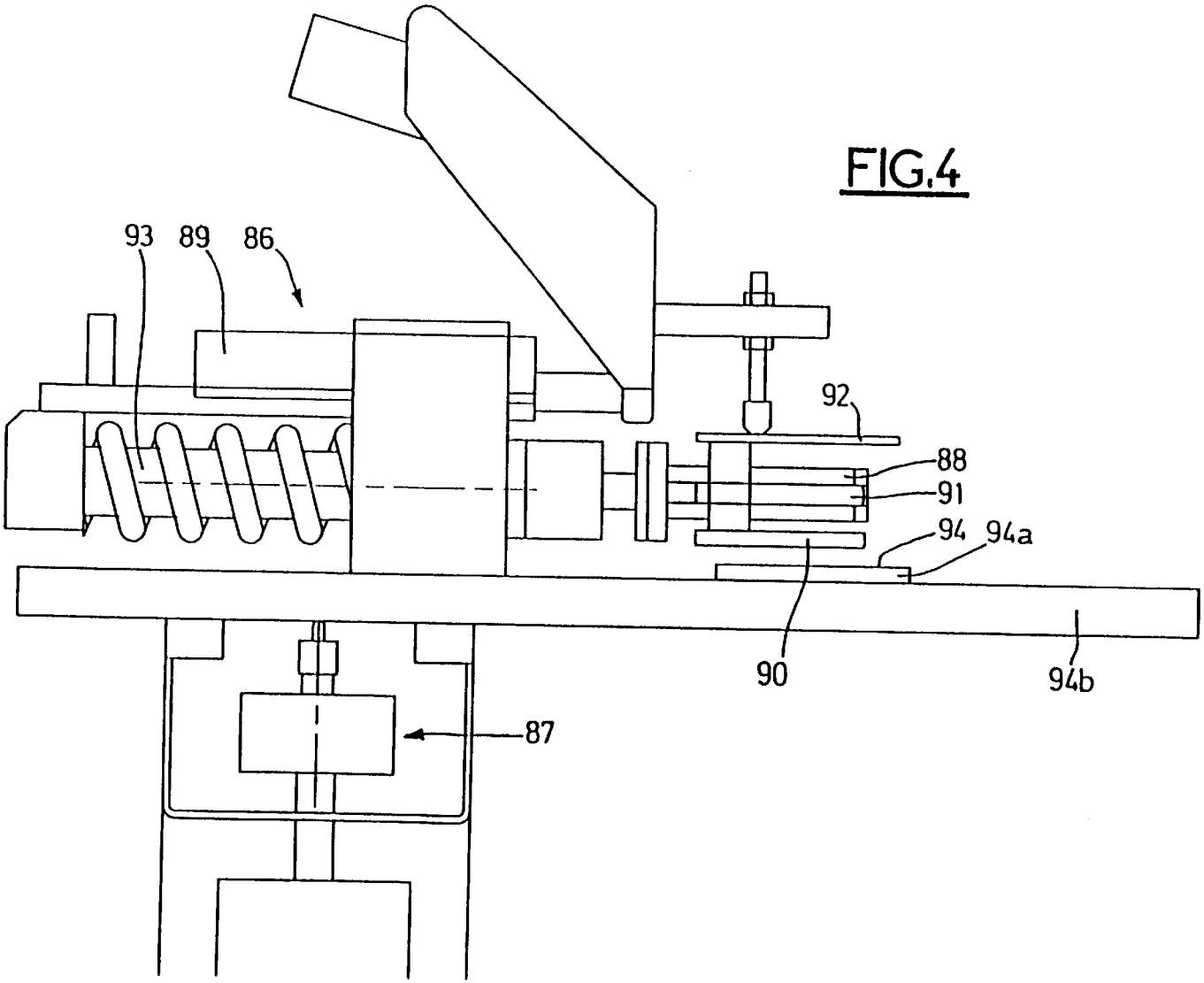
FIG. 4 represents a lateral view of an operating head of the machine of FIG. 3.

Referring now to FIG. 2, a fixed closure identified in a general manner by the reference 59 will now be described.

This closure includes a frame 60 which has a structure identical to that of the frame 2 of closure 1, that is to say that it is constructed using a profiled member comprising an outer profiled member 5 and an inner profiled member 6 which are joined together by longitudinal joining strips 7.

The frame 60 bears on its inner side, an intermediate frame identified in a general manner by the reference 61 which is constructed from a profiled member 62.

This profiled member 62 exhibits a longitudinal wall 63 which extends perpendicularly to the plane of the frame 60. This wall 63 bears two longitudinal walls 64 and 65 which extend parallel to the plane of the frame 60, and the end edges of which are in engagement with the catching ribs 31 and 33 of the frame 4, as well as a longitudinal wall 66 which extends from its inner edge and the end edge of which bears against the catching rib 32 of the profiled member 4, parallel to the plane of the frame 60. Furthermore, the other edge of the wall 63 exhibits a longitudinal rib 67 in which there is engaged the longitudinal fastening part of a gasket 68 which bears against the rib 20 of the profiled member 4.

The closure 59 exhibits a panel 69, for example a double glazing unit, which extends inside the intermediate frame 61 and which bears against the wall 63 of the profiled member 62 via a gasket 70. The longitudinal part of a longitudinal gasket 71 is engaged in the rib 24 of the profiled member 4, the outer face of the panel 69 coming to bear against this gasket.

The closure furthermore comprises a holding frame identified in a general manner by the reference 72 and constructed from a profiled member 73.

This profiled member 73 comprises a wall 74 which extends parallel to the plane of the frame 60 and which constitutes the inner face of the closure 59. Starting from this wall 74, the profiled member 73 exhibits a longitudinal wall 75, the edge of which bears against the inner face of the wall 28 of the profiled member 4 or its rib 32, a longitudinal wall 76 which extends in front of the wall 63 of the intermediate frame 61 and the edge of which is in engagement with a longitudinal holding rib 77 provided on the inner side of this wall 63, as well as a longitudinal wall 78, in the shape of an S, the longitudinal edge of which bears a longitudinal gasket 79 which comes to bear against the inner face of the panel 69.

It follows that the peripheral part of the faces of the panel 69 is sandwiched between the gaskets 71 and 79 and this panel 69 is thus held firmly by the frame 72.

It can be observed that the outer and inner faces of the panel 69 are placed symmetrically with respect to the wall 16 of the profiled member 4, which constitutes the outer face of the frame 60, and the wall 74 of the frame 72, which constitutes the inner face of the closure 59, and that the shape of the wall 78 of the holding frame 72 is substantially symmetric and the same shape as the walls 17 and 23 of the profiled member 4, with the gasket 71 as an extension of it.

Furthermore, the joining brackets 34 and 53 exhibit the same section and the joining brackets 35 and 54 also exhibit the same section, the longitudinal channels of the profiled members 4 and 37 being sized accordingly.

Referring to the subsequent figures, the way in which the frames 2 and 36 may be joined together using a machine bearing clamping and punching tools, identified in a general manner by the reference 80, will now be described.

This punching machine 80 comprises two fixed guide beams 81 and 82 which are horizontal and parallel, as well as two guide beams 83 and 84 which are perpendicular to beams 81 and 82. The beam 83 is, for example, mounted at fixed station on the beams 81 and 82 whereas the beam 84 can move along the beams 81 and 82 by virtue of known drive means identified by the reference 85.

The beams 83 and 84 respectively bear two clamping and punching heads 86 which can move along the latter by virtue of known drive means identified by the reference 87.

Each head 86 bears a clamping bracket 88, the branches of which are parallel to the aforementioned beams, these clamping brackets being able to move at 45° with respect to the aforementioned beams by virtue, for example, of rams 89.

Furthermore, each head 86, in the example, bears three double punches 90, 91 and 92 which are provided with punch pins and the branches of which are respectively associated with the branches of the clamping brackets 88, these punches being articulated about vertical axes 93*a* and being able to be driven in rotation at the same time by virtue, for example, of a ram 93.

Furthermore, the machine 80 exhibits a bearing surface 94 which extends horizontally at a level lower than that of the lower punch 90 as well as bearing pads 95 situated at its middle. This bearing surface 94 in the example is formed by removable shims 94*a* placed on the upper surface of a bed 94*b* of the machine.

The machine 80 furthermore exhibits electronic or electric control means able to place the heads 80 in given positions with respect to one another so as to form, between the four clamping brackets 88, a rectangle of given size and also means for steering the means for moving the clamping brackets 88 and pairs of punches 90, 91 and 92.

With a view to manufacturing the frame 2 consisting of the profiled member 4 described earlier, the machine 80 may be used as follows.

First of all, after having mitered the pieces of profiled member 4 which are to form the uprights and crosspieces of the frame 2, these pieces are joined together, for example on an auxiliary bench, by engaging the branches of the joining brackets 34 and 35 in the longitudinal channels 18 and 29 of the profiled member 4 so as to prefabricate the frame 2.

Next, the dimensions of the frame to be obtained are entered into the control means of the machine 80. These means automatically position the heads 86 of the machine 80 in positions such that the size of the rectangle determined by the clamping brackets 88 is slightly greater than the size of the frame 2 thus prefabricated.

Figure 5:
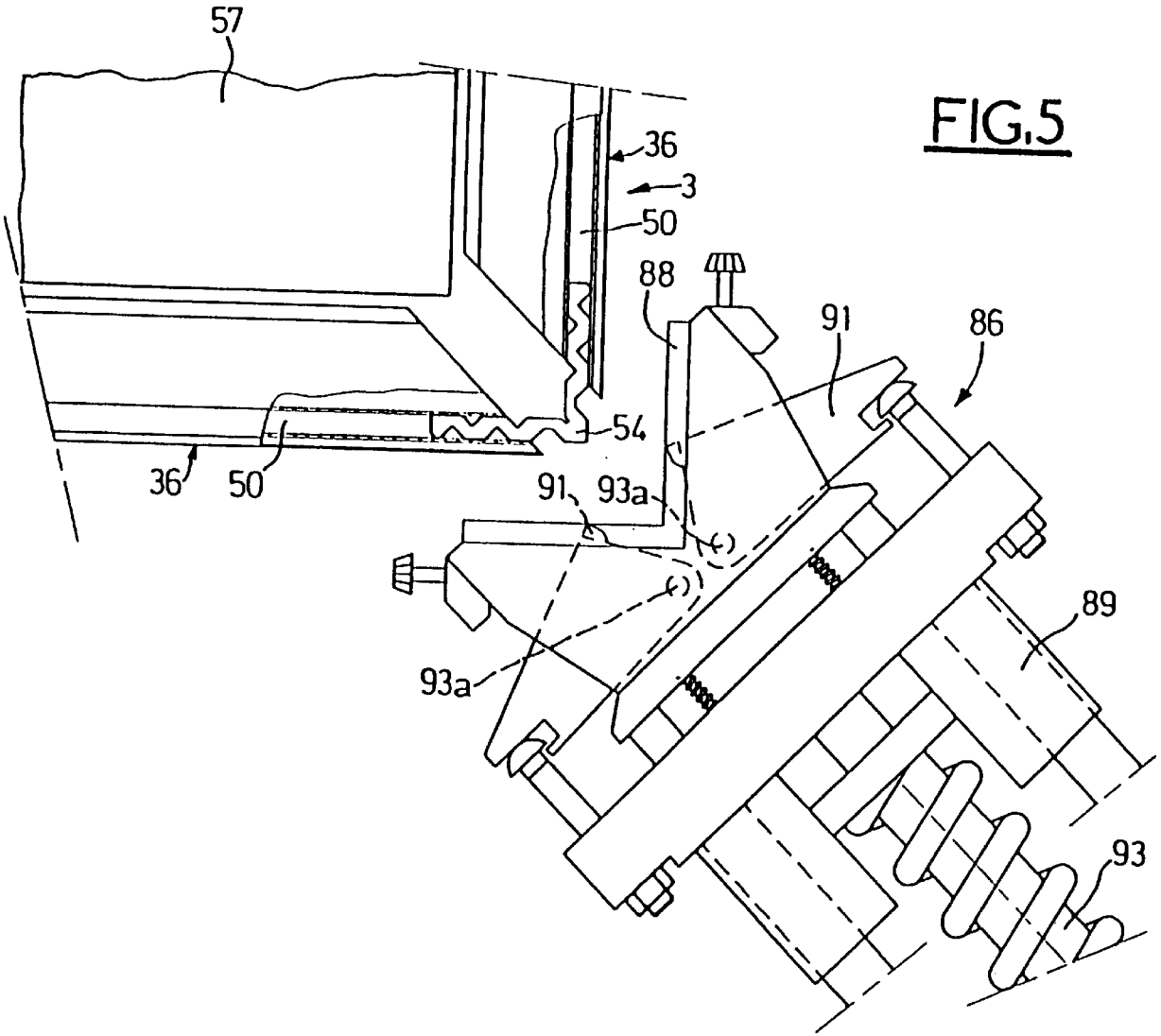
FIG. 5 represents a plan view of an operating head of the machine of FIG. 3 in its initial position before operations.

The prefabricated frame 2 is placed between the clamping brackets 88 in a position such that the wall 28 of the profiled member 4, which constitutes a reference face of the frame 2, bears against the reference surface 94 of the machine 80, as FIG. 5 shows.

Figure 6:
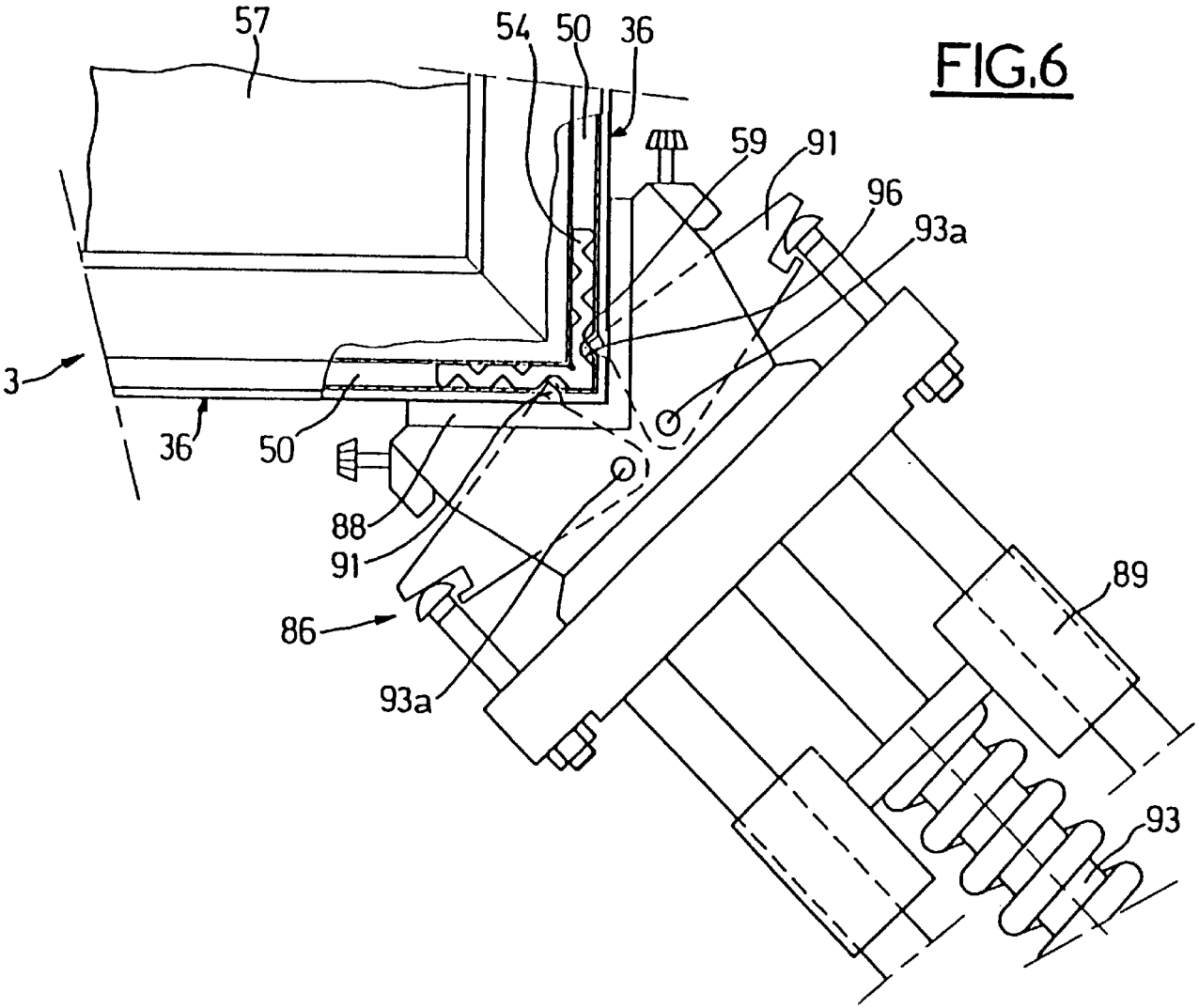
FIG. 6 represents a plan view of an operating head of the machine of FIG. 3 in its final position after operations.
Figure 7:
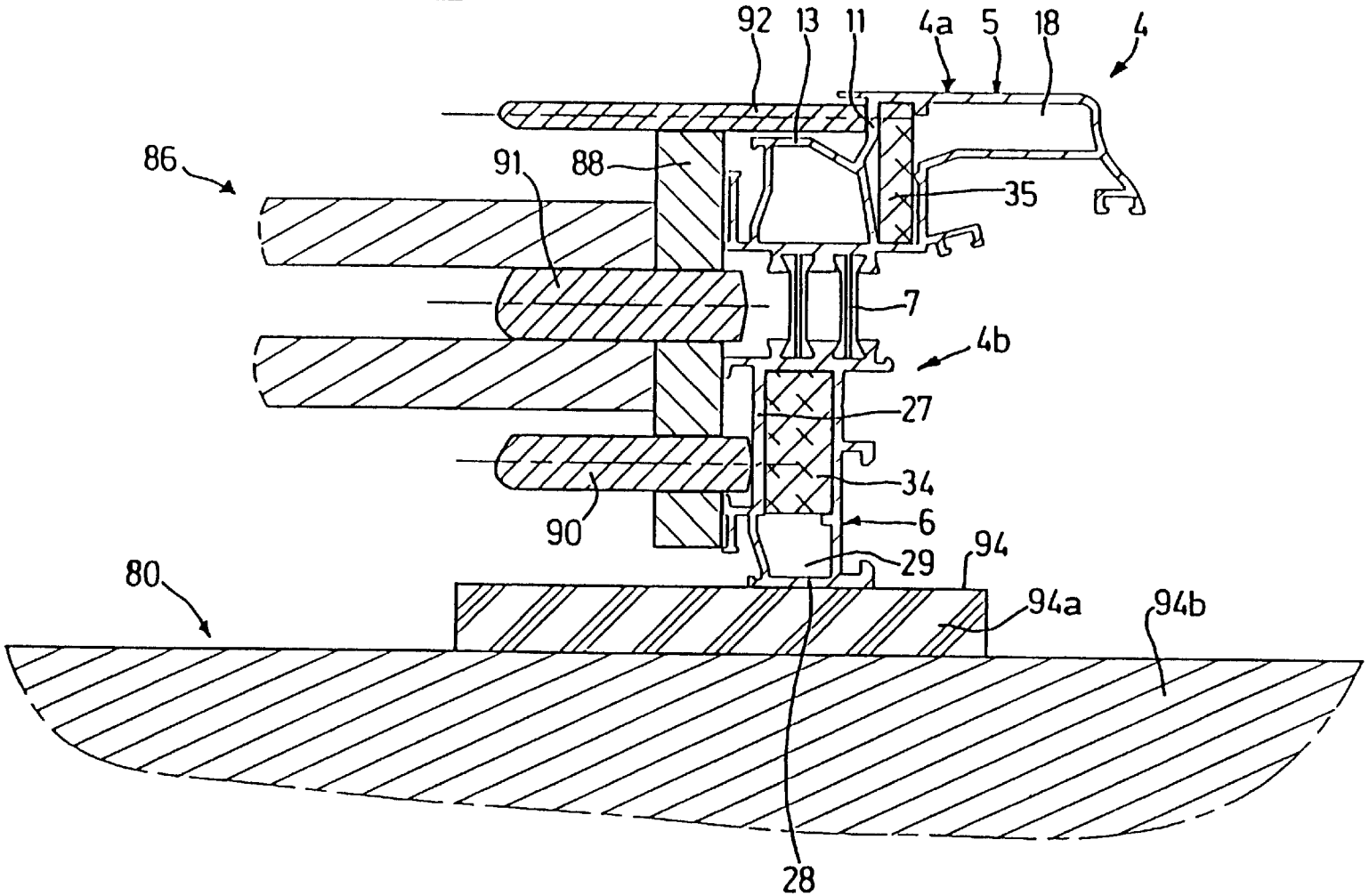
FIG. 7 represents a section of an operating head of the machine of FIG. 3 in its position of executing operations on a profiled member.

The control means of the machine are then actuated in such a way that they initiate the process for manufacturing the frame 2 which takes place as follows, as shown by FIGS. 5, 6 and 7.

The clamping brackets 88 of the heads 86 are actuated to move simultaneously, at 45°, and grasp and compress the corners of the frame 2, from the outside of this frame 2.

The double punches 90, 91 and 92 of the punching heads 86 are then actuated simultaneously and pivot toward the peripheral wall of the frame 2. While this is happening, the pins of the lower punches 90 engage in the wall 27 of the profiled member 4 and the pins of the upper punches 92 engage in the wall 11 of the profiled member 4, passing over its wall 13, whereas the central punches 91 engage between the walls 8 and 9 of the profiled member 4, toward the joining strips 7, without however touching these walls 8 and 9 and these strips 7.

The lower punches 90 locally deform the wall 27 of the profiled member 4 inward and the upper punches 92 locally deform the wall 11 of the profiled member 4, the deformations 96 thus obtained becoming engaged in recesses 97 in the joining brackets 34 and 35 so as to fix the corners of the frame 2 firmly.

Next, the punches 90, 91 and 92 and the clamping brackets 88 of the heads 86 are returned to their initial position, releasing the frame 2 thus manufactured.

Finally, the frame 2 is removed.

Figure 8:
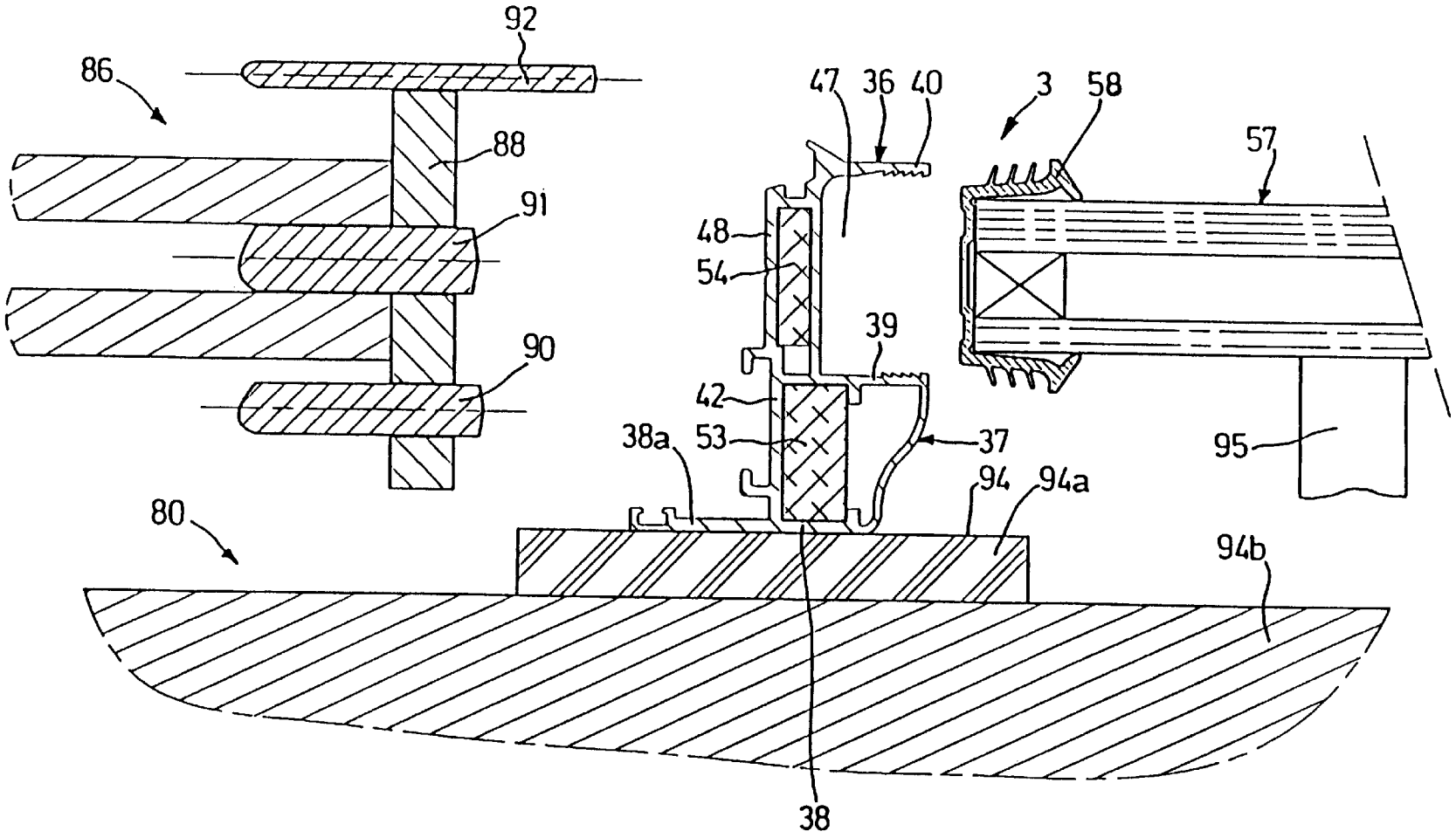
FIG. 8 represents a section of an operating head of the machine of FIG. 3 in its initial position of executing operations on another profiled member.
Figure 9:
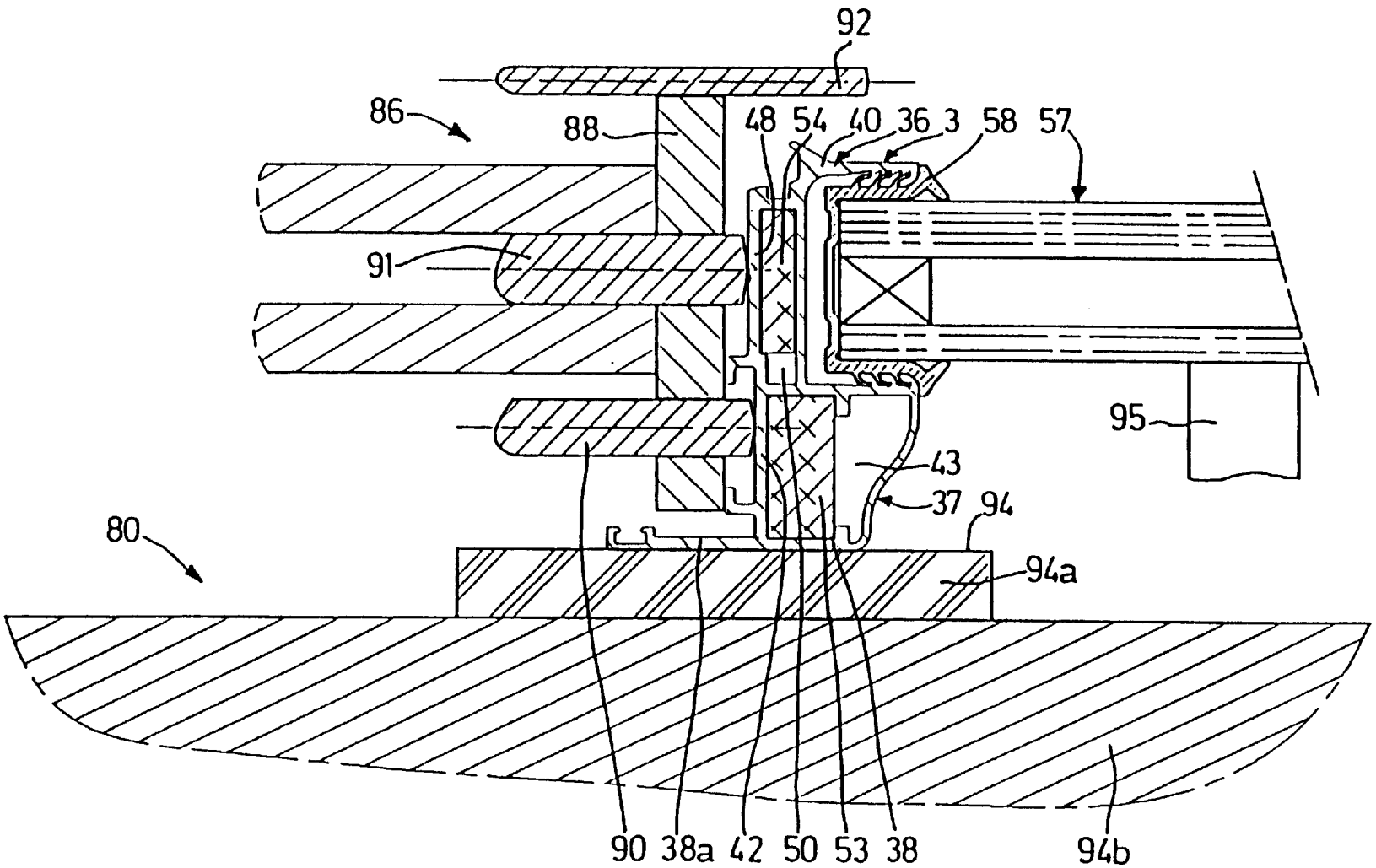
FIG. 9 represents a section of an operating head of the machine of FIG. 3 in its final position of executing operations on this other profiled member.

The way in which the punching machine 80 may be used to manufacture the frame 36 of the opening leaf 3 as shown by FIGS. 6, 8 and 9, without altering the settings of the punching tools 90, 91 and 92 and of the clamping brackets 88 will now be described.

First of all, pieces of profiled member 37 which are to constitute the uprights and crosspieces of the frame 36 to be manufactured are mitered.

On an auxiliary bench, the branches of the brackets 54 are partially engaged in the channels 50 of these pieces so as to construct a preformed frame 36 whose internal space bounded by the inner edges of the walls 49 and 40 of the profiled member 37 is greater than the surface area of the panel 57.

As before, the dimensions of the frame 36 to be manufactured are programmed so that the heads 86 of the machine 80 automatically come into given positions such that the surface area bounded by the brackets 88 is greater than the surface area of the preassembled frame 36 as was just described.

Next, the preformed frame 36 is placed on the reference surface 94 of the machine, in the space between the brackets 88 of the heads 86, in a position such that its wall 38, which constitutes a reference face, bears against the reference surface 94.

The panel 57 is placed resting on the pads 95, in a position such that its peripheral edge faces the slot 47 in the profiled member 37.

Next, the following automatic operations of the machine 80 are set into action, these taking place, as before, as follows.

The clamping brackets 88 move toward the corners of the frame 3 and cause the uprights and crosspieces of this frame to move closer together, causing the brackets 54 to slide into the channels 50 of the profiled member 37 until the corners come into contact. At the same time, the peripheral edge of the panel 57 engages in the slot 47 of the profiled member 37 around the entire periphery of the frame 3.

Next, the three punches 90, 91 and 92 are actuated and move simultaneously toward the peripheral wall of the frame 3. While this is happening, the central punches 91 locally deform the wall 48 of the profiled member 37 inward and the lower punches 90 cause a local inward deformation of the wall 42, whereas the upper punches 92 pass over and some distance from the wall 47 of the profiled member 37.

As before when manufacturing the frame 2, deformations 96 engage in recesses 97 of the branches of the joining brackets 53 and in recesses of the branches of the joining brackets 54.

Finally, the punches 90, 91 and 92 and the clamping brackets 88 of the heads 86 are returned to their initial position.

The opening leaf 3 thus manufactured can then be removed.

Next, the operations of manufacturing the closure 1 may be completed by fitting the gaskets described earlier and mounting the hinges, locking members and any other worthwhile accessory.

The operations which have just been described for manufacturing the frame 2 and the opening leaf 3 are rendered possible through the fact that the shapes of the profiled members 4 and 37, the position of the punches 90, 91 and 92 in terms of height with respect to the reference surface 94 of the machine 80 and their position parallel to this reference surface 94, the position of the clamping brackets and also the positions of the channels which respectively take the joining brackets 34, 35, 53 and 54 are such that it is possible to lock the joining brackets 34 and 35 of the frame 4 by deforming the walls of the latter using the punches 90 and 92 and that it is possible to lock the joining brackets 53 and 54 of the profiled member 37 of the frame 36 by deforming the wall of the latter using the punches 90 and 91, without, in the first instance, the punches 91 encountering the profiled member 4, and without in the second instance, the punches 92 encountering the profiled member 37.

As a result, all that is required is to set the positions of the punches 90, 91 and 92 of the machine 80 once and for all. By virtue of having done so, it is equally possible to manufacture either frames 2 or frames 36, with or without a panel 57, on the machine 80 without altering these settings. All that is required is to enter the dimensions of the frame to be obtained into the programming facilities of the machine 80, and after having placed the frame on the machine, in actuating its automatic clamping and punching means.

It is thus possible to manufacture a frame 2 and an opening leaf 3 in succession in order to obtain a closure 1, to repeat these operations to obtain another closure 1, for example of a different size, and/or to manufacture frames 60 with a view subsequently to forming the fixed closure 59. Of course it is possible to execute shaping operations on the profiled members 4 and 37, possibly cut into pieces, before proceeding with the operations of preassembling the frames 2 and 36 and/or before executing shaping operations on these frames after they have been manufactured using preset tools on suitable machines which have a reference surface, for example drilling or milling operations, in particular for carrying out these operations at equal distances from their aforementioned reference faces or their opposite faces.

The present invention is not limited to the examples described hereinabove. In particular, the number of punching tools and the tools used could be different. The invention could apply also to all sorts of shapes of suitable profiled member as described, and on all sorts of suitable machine as described.

What is claimed is:

1. A method of shaping profiled frame members on a machine using at least one tool from a set of interconnected tools, said method comprising the steps of:

presetting the position of the tools of a set of interconnected tools with respect to at least one reference surface of the machine so that the tools are positioned to act differently on differing profiled members which are to be shaped;

placing a predetermined reference face of the profiled frame member to be shaped on the reference surface of the machine, moving the tools in unison with respect to the profiled frame member, and shaping the profiled frame member with the at least one tool of the set of tools in at least one wall of the profiled frame member, wherein the presetting of the position of the tools causes the tools to act differently on profiled frame members of differing sections which are placed on the reference surface one after another and to undergo the desired operations with the use respectively of the tools corresponding to the desired operations for each of the profiled frame members.

2. The shaping method according to claim 1, wherein the set of tools comprises rotary machining tools.

3. The shaping method according to claim 1, wherein the set of tools comprises punching tools.

4. The shaping method according to claim 1, wherein the shaping is a punching operation which comprises:

placing in the profiled frame member to be shaped an inner piece engaged longitudinally inside the profiled frame member, and carrying out the punching operation using at least one of the punching tools of the set of tools so as to deform the profiled frame member inward.

5. A method of manufacturing frames having profiled frame members connected by joining pieces which are engaged longitudinally in adjacent profiled frame members of the frame, on a punching machine using punching tools, said method comprising the steps of:

presetting the position of a set of interconnected punching tools with respect to at least one reference surface of the machine, so that the tools are positioned to act differently on differing profiled members which are to be shaped;

preassembling the frames to be manufactured using the joining pieces, placing a predetermined reference face of the frame to be manufactured on the reference surface of the machine, and moving the punching tools in unison with respect to the profiled frame member so as to carry out the punching operation using at least one of the punching tools of the set of punching tools in order to deform the profiled members inward into slotted parts of the joining pieces, wherein the presetting of the position of the punching tools causes the tools to act differently on frames comprising profiled members having differing sections which are placed on the reference surface one after another and to undergo the desired operations with the use respectively of punching tools corresponding to the desired operations for each of the profiled frame members selected from the set of punching tools.

6. The method of manufacturing frames according to claim 5, wherein the placing of the frame is in a sideways orientation with respect to the set of punching tools.

7. The method of manufacturing frames according to claims 5, wherein each frame is formed from profiled frame members having an identical section.

8. The method of manufacturing frames according to claims 5, said method further comprising a preliminary step of mitering the ends of four pieces of the profiled frame member prior to preassembling the pieces as a frame.

9. A method of manufacturing frames having profiled frame members connected by joining pieces which are engaged longitudinally in adjacent profiled frame members of the frame, on a punching machine using punching tools, said method comprising the steps of:

presetting the position of a set of interconnected punching tools with respect to at least one reference surface of the machine so that the tools are positioned to act differently on differing profiled members which are to be shaped;

preassembling the frames to be manufactured using the joining pieces in such a way that opposing parts of the frame are separated;

placing a predetermined reference face of a frame member of the frame to be manufactured on the reference surface of the machine;

placing a panel within the frame;

bringing the opposed parts of the frame together to engage the panel in slots of the frame; and moving the punching tools in unison with respect to the profiled frame member so as to carry out the punching operation using at least one of the punching tools of the set of punching tools in order to deform the profiled members inward into slotted parts of the joining pieces;

wherein the position of the punching tools causes the tools to act differently on frames using profiled frame members having differing sections which are placed on the reference surface one after another and to undergo the desired operations with the use of punching tools corresponding to the desired operations for each of the profiled frame members.

* * * * *